US007445482B2

(12) United States Patent
Ho

(10) Patent No.: US 7,445,482 B2
(45) Date of Patent: Nov. 4, 2008

(54) EDGE CONNECTOR WITH SLOT RIBS

(75) Inventor: Yi-Tse Ho, Tainan Hsien (TW)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 11/726,227

(22) Filed: Mar. 21, 2007

(65) Prior Publication Data

US 2007/0238344 A1 Oct. 11, 2007

(30) Foreign Application Priority Data

Mar. 21, 2006 (TW) ..... 95204709 U

(51) Int. Cl.
*H01R 13/62* (2006.01)

(52) U.S. Cl. ..... 439/326

(58) Field of Classification Search ..... 439/352–328
See application file for complete search history.

(56) References Cited

U.S. PATENT DOCUMENTS 5,755,585 A * 5/1998 Cheng et al. ..... 439/326
5,833,478 A * 11/1998 Tseng et al. ..... 439/326
6,419,513 B1 * 7/2002 Choy ..... 439/326
6,503,093 B1 * 1/2003 Sakata et al. ..... 439/328
6,802,732 B1 * 10/2004 Bu et al. ..... 439/328

* cited by examiner

*Primary Examiner*—Ross N Gushi
(74) *Attorney, Agent, or Firm*—Robert J. Zeitler

(57) ABSTRACT

A card edge connector includes an insulating body, a plurality of terminals, and two metallic pieces. The insulating body has a body portion and two side frames. The body portion has an insertion slot. The top and bottom surfaces within the insertion slot have a plurality of flanges. The advantage of the present invention lies in that the interior of the insertion slot has a plurality of flanges. Therefore, the insertion slot can be made wider to facilitate the insertion of an electric card and prevent the phenomenon that the electric card cannot be inserted into the insertion slot due to the deformation of the insertion slot. When the electric card is inserted, the flanges abut against the upper and lower surfaces of the electric card, so that the electric card can be stably fixed in the insertion slot. As a result, the electric card has greater stability.

19 Claims, 10 Drawing Sheets

EDGE CONNECTOR WITH SLOT RIBS

FIELD OF THE INVENTION

The present invention relates to a card edge connector, and in particular to a card edge connector provided on the upper surface of a circuit board that facilitates the insertion of an electric card, whereby the electric card can be stably inserted into an easily formed insertion slot and the manufacturing cost of the card edge connector is reduced.

BACKGROUND OF THE INVENTION

The conventional card edge connector is provided on the upper surface of a circuit board and allows the insertion of an electric card, thereby electrically connecting the circuit board and the electric card. Taiwan Patent Publication No. 392938 (Application No. 84205546) published on Jun. 1, 2000 discloses a linear module connector comprising an upper layer connector and a lower layer connector. Both connectors are stacked in a vertical direction. The upper layer connector and the lower layer connector each comprise an insulating body having a central slot (insertion slot). The insulating body is provided with a plurality of terminals for electrically connecting the electric card and the circuit board.

As shown in FIG. 1, the insulating body 91 of the conventional card edge connector 9 is provided with an insertion slot 911 for allowing the insertion of the electric card 8. Since the insulating body 91 is made of plastic material, and the insertion slot 911 is formed into an elongated stripe, it is prone to deformation. As a result, it is not easy to insert the electric card 8. Therefore, the insertion slot 911 is usually made wider to facilitate the insertion of the electric card 8, thereby preventing the deformation of the insertion slot 911 which in turn may block the insertion of the electric card 8. However, in such situation, the electric card may not be stably fixed into the insertion slot and the stability thereof is poor. As a result, it is difficult to ensure the electrical connection between the electric card and the card edge connector. Therefore, the electrical properties between the electric card and the card edge connector are poor. In view of this, the inventor proposes the present invention to overcome the above problems based on his expert experience and deliberate research.

SUMMARY OF THE INVENTION

The primary object of the present invention is to provide a card edge connector which ensures the electrical connection between the electric card and the card edge connector to generate better electrical properties.

In order to achieve the above object, the present invention provides a card edge connector for allowing the insertion of an electric card, which comprises an insulating body, a plurality of terminals, and two metallic pieces. The insulating body has a body portion and two side frames extending from both ends of the body portion. The body portion is provided with an insertion slot. The top surface and the bottom surface within the insertion slot are provided with a plurality of flanges. The free ends of the two side frames each extend to form an elastic hooking arm. The terminals are provided on the body portion of the insulating body. The metallic pieces are mounted on the two elastic hooking arms.

The advantage of the present invention lies in that the interior of the insertion slot of the card edge connector is provided with a plurality of flanges. Therefore, the insertion slot can be made wider to facilitate the insertion of the electric card and prevent the phenomenon that the electric card cannot be inserted into the insertion slot due to deformation of the insertion slot. When the electric card is inserted into the insertion slot, the flanges on the top surface and the bottom surface of the insertion slot can be used to abut against the upper surface and lower surface of the electric card respectively, so that the electric card can be stably fixed in the insertion slot. As a result, the electric card has greater stability and generates better electrical properties.

In order to better understand the characteristics and technical contents of the present invention, a detailed description thereof will be made with reference to the accompanying drawings. However, it should be understood that the drawings and the description are illustrative and are not to be used to limit the scope of the present invention.

BRIEF DESCRIPTION OF THE DRAWINGS

The organization and manner of the structure and operation of the invention, together with further objects and advantages thereof, may best be understood by reference to the following description, taken in connection with the accompanying non-scale drawings, wherein like reference numerals identify like elements in which.

DETAILED DESCRIPTION OF THE INVENTION

Figure 1:
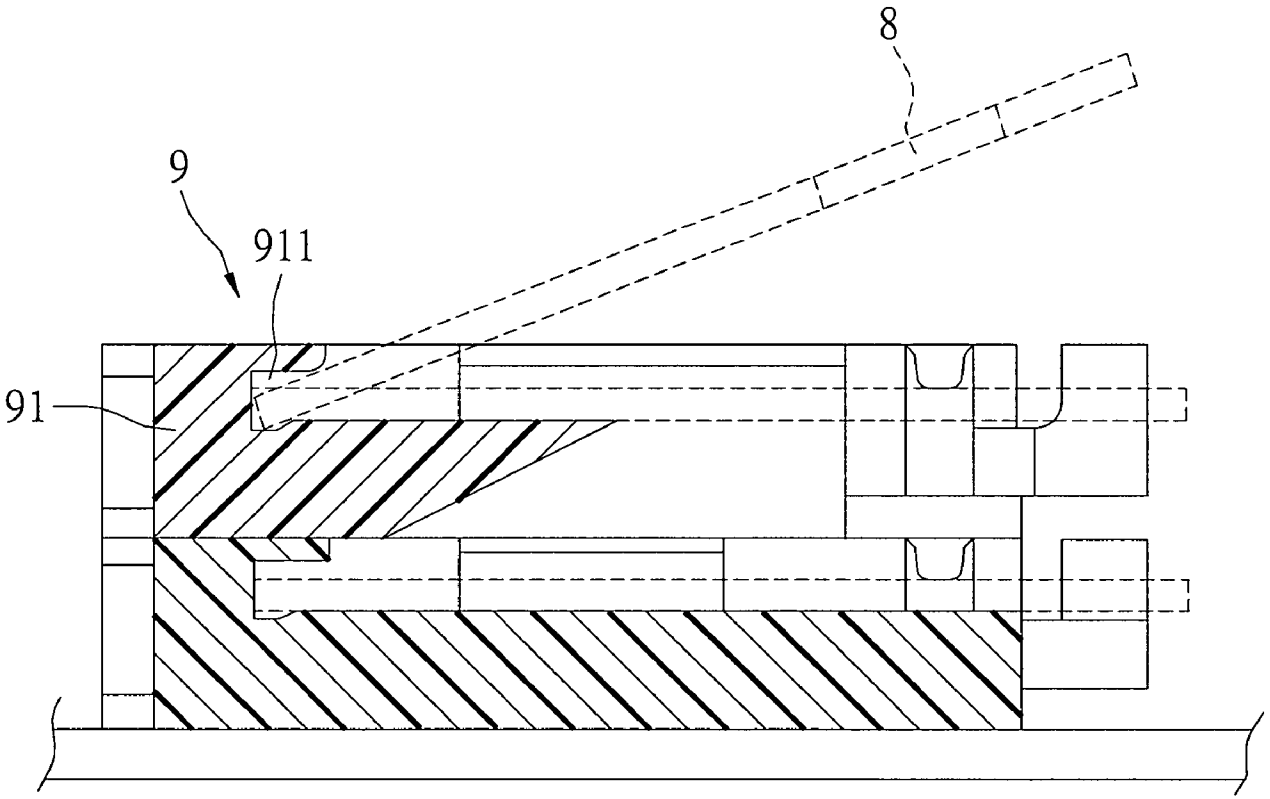
FIG 1 PRIOR ART
FIG. 1 is a schematic view showing an electric card inserted into the conventional card edge connector.
Figure 2:
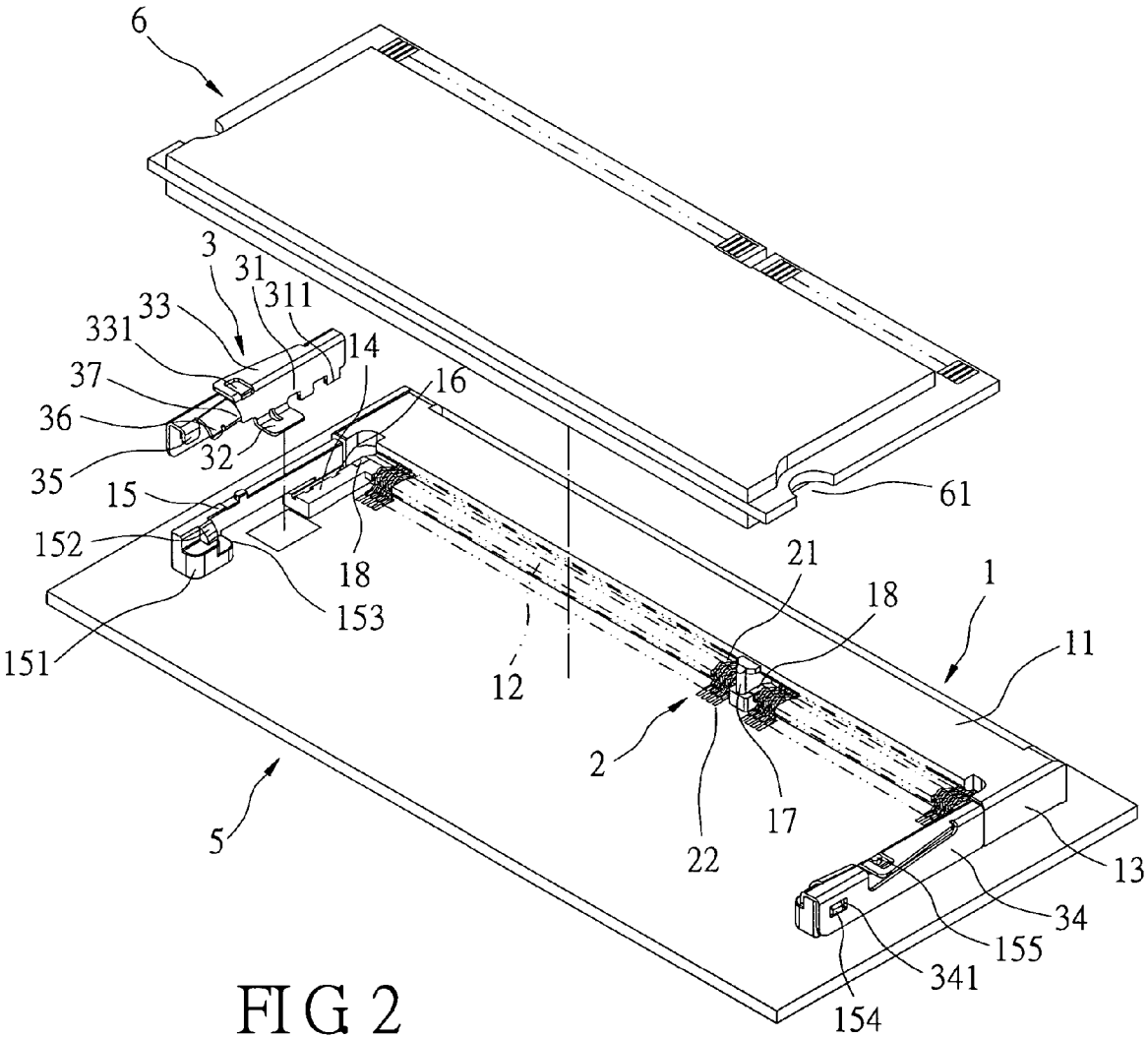
FIG. 2 is an exploded perspective view of the card edge connector of the present invention, a circuit board and an electric card.
Figure 3:
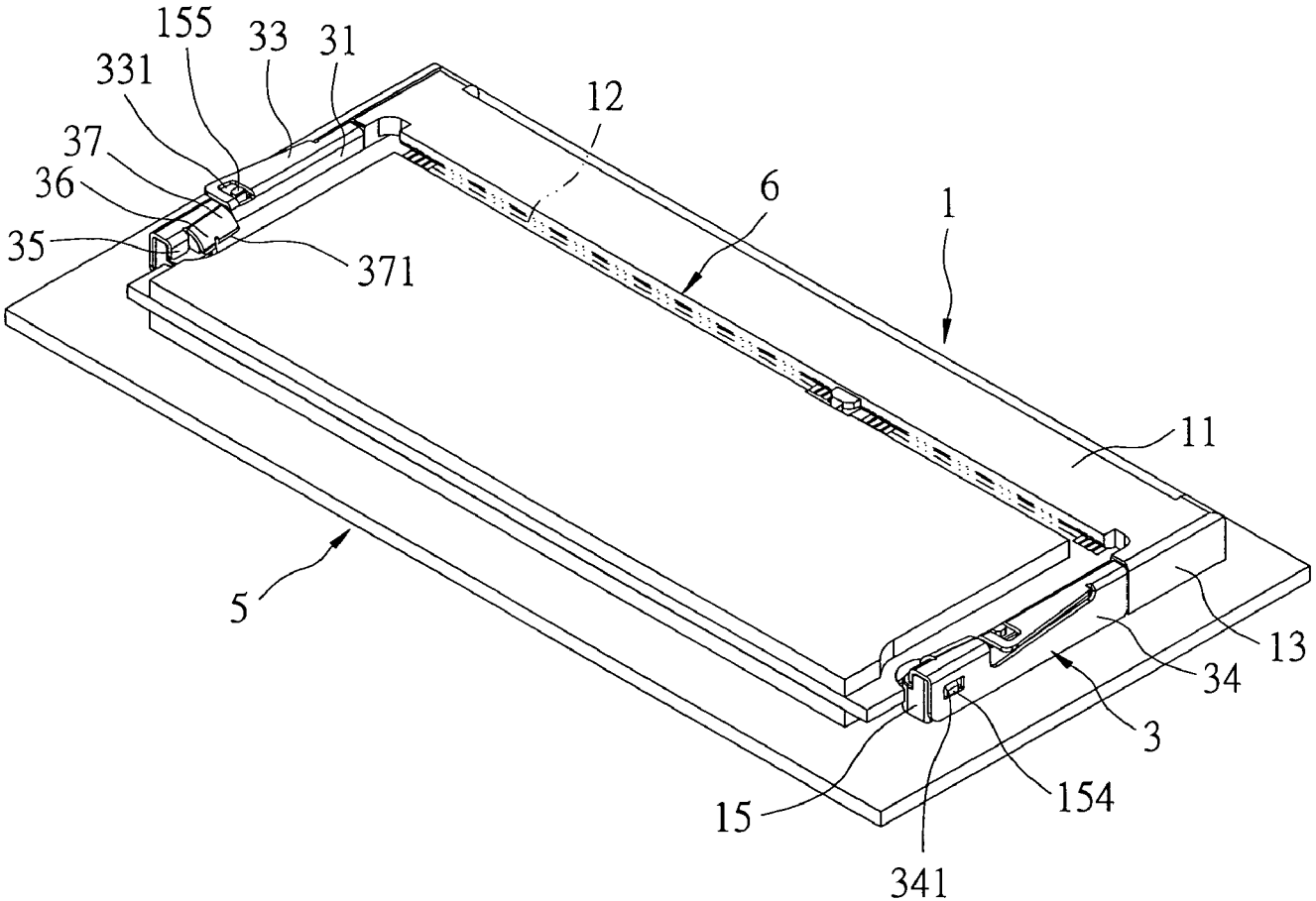
FIG. 3 is an assembled perspective view of the card edge connector of the present invention, a circuit board and an electric card.
Figure 4:
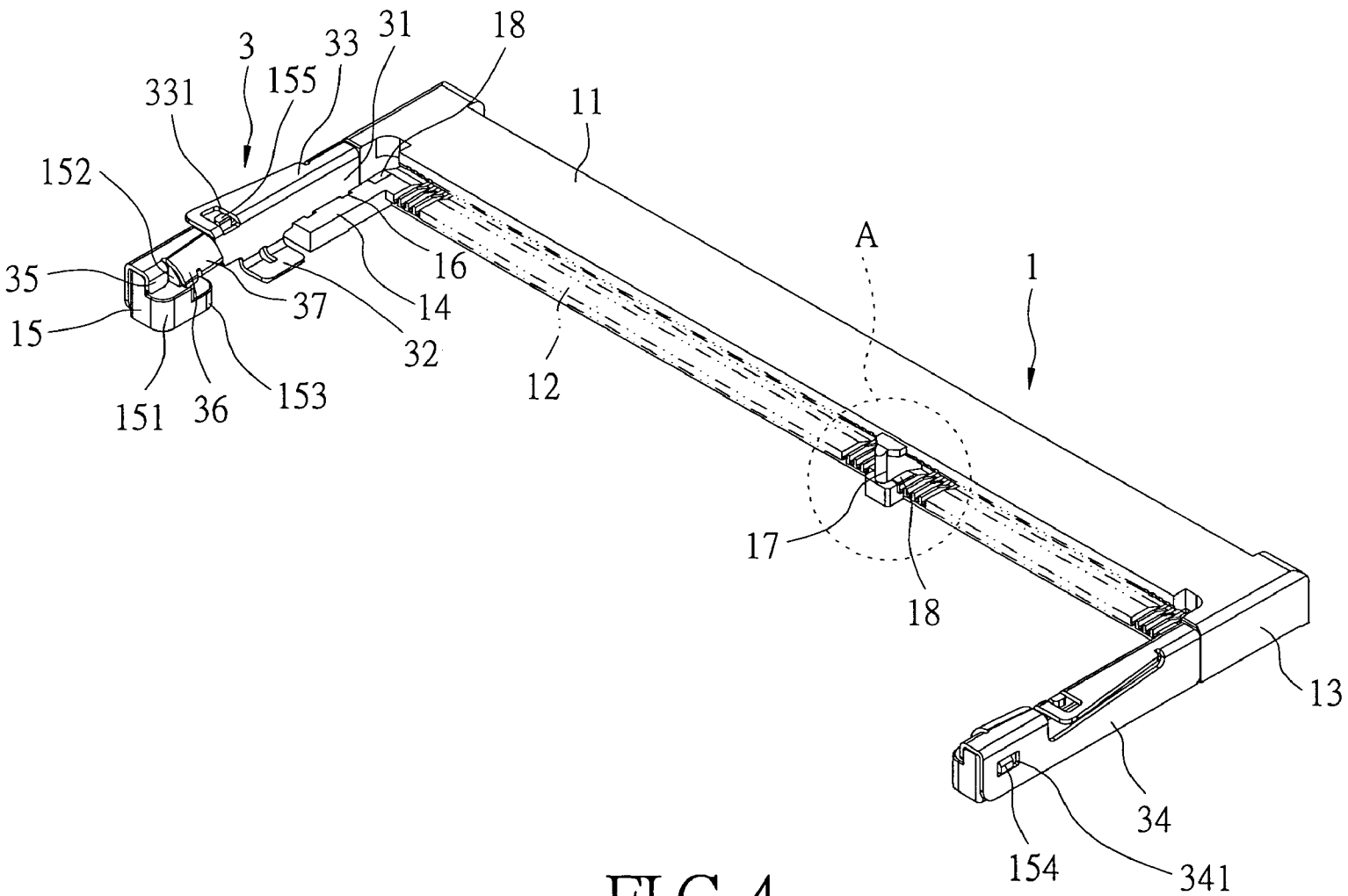
FIG. 4 is a perspective view showing the card edge connector of the present invention.
Figure 4A:
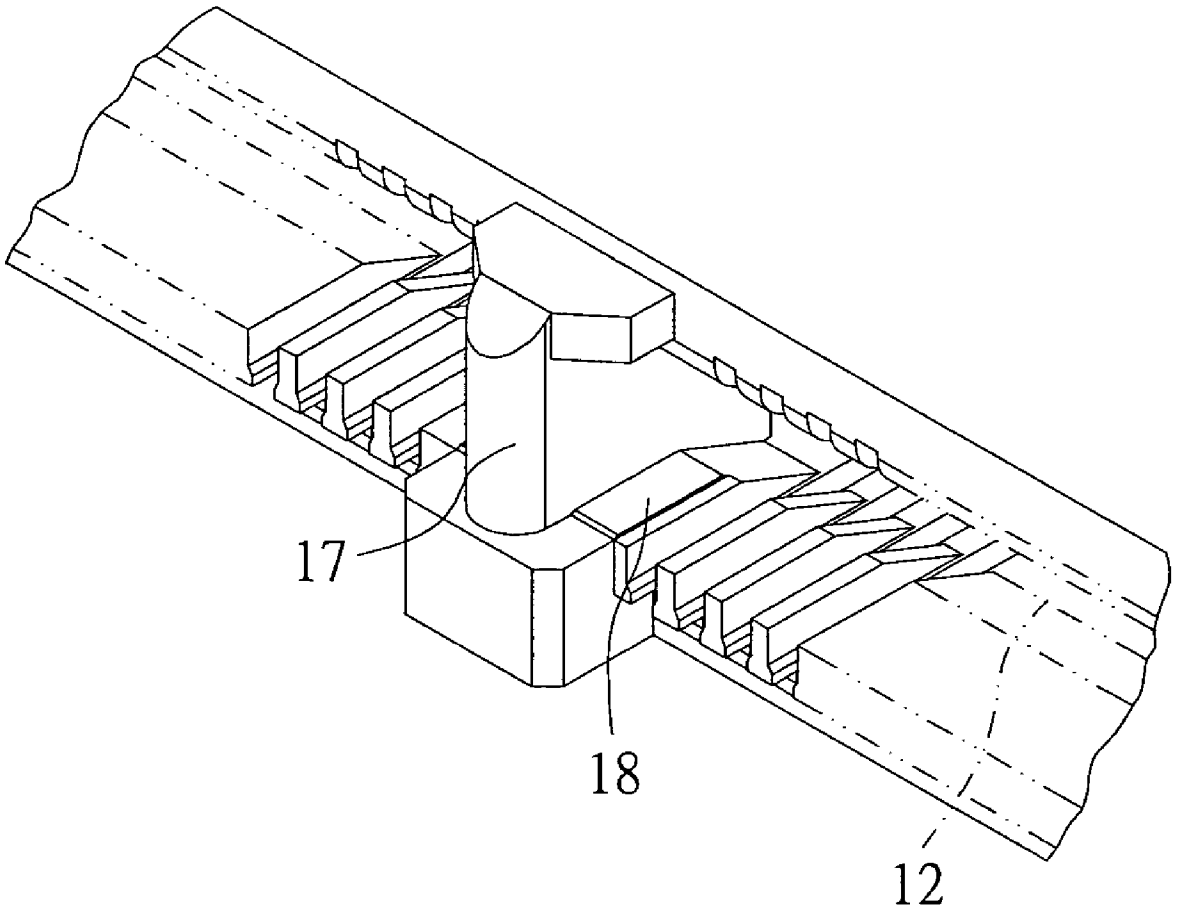
FIG. 4A is a view showing the details of the portion A in FIG. 4.
Figure 5:
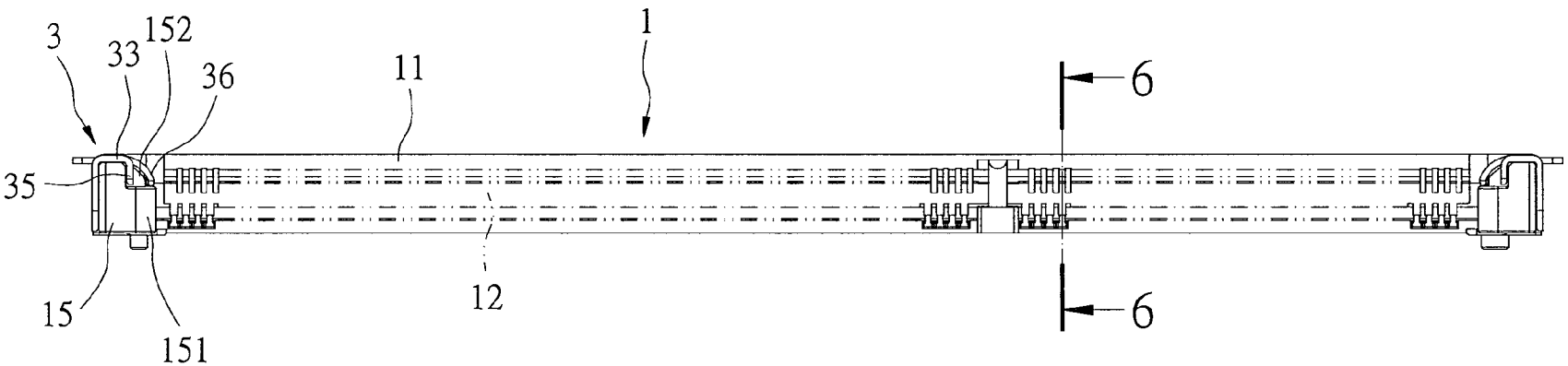
FIG. 5 is a front view showing the card edge connector of the present invention without assembling terminals.
Figure 6:
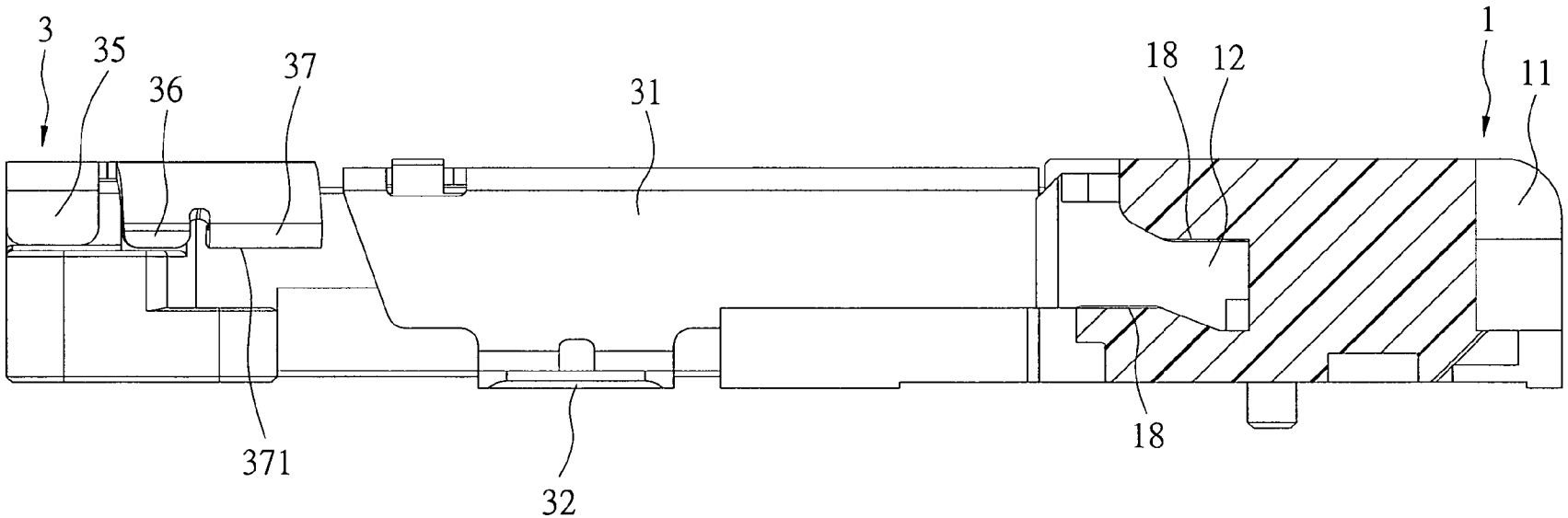
FIG. 6 is a cross-sectional view taken along the line 6-6 in FIG. 5.
Figure 7:
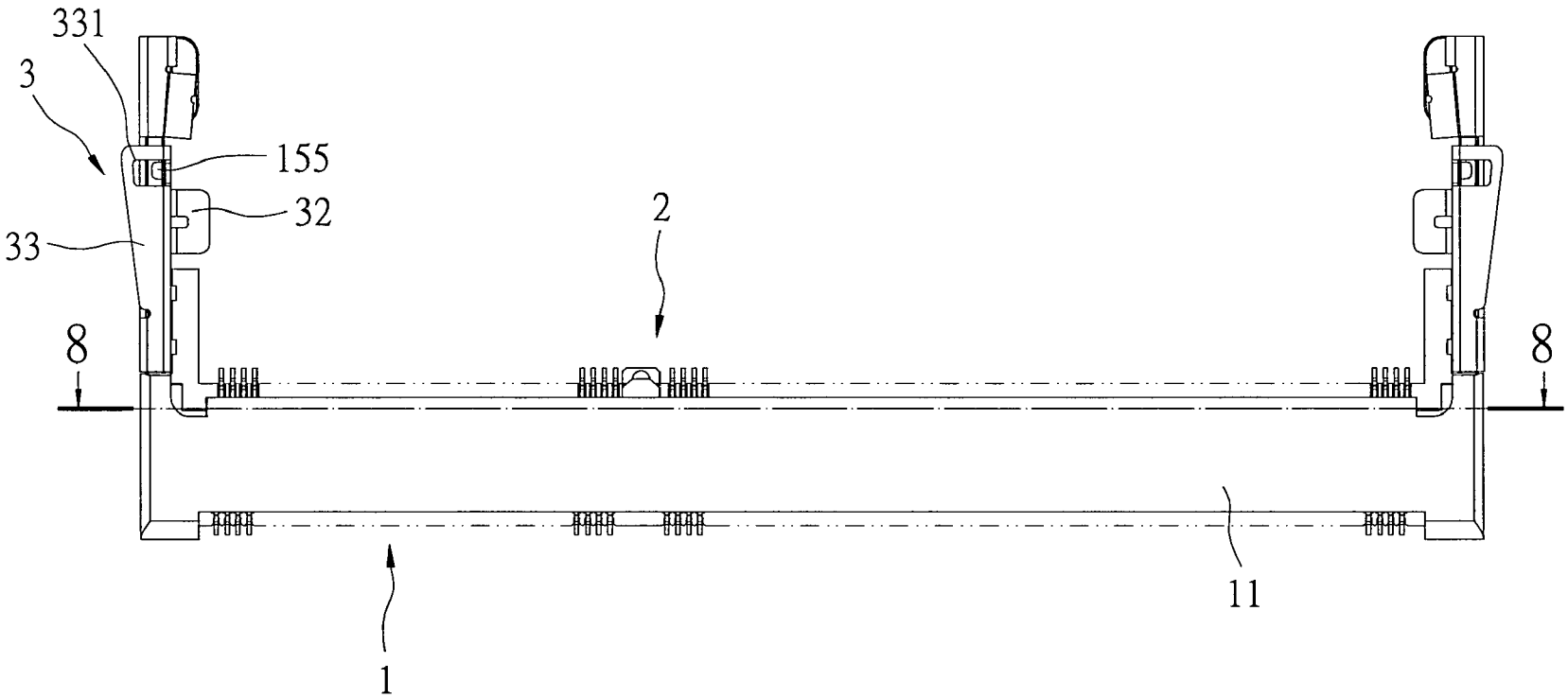
FIG. 7 is a top view showing the card edge connector of the present invention.

While this invention may be susceptible to embodiment in different forms, there is shown in the drawings and will be described herein in detail, a specific embodiment with the understanding that the present disclosure is to be considered an exemplification of the principles of the invention, and is not intended to limit the invention to that as illustrated.

With reference to FIGS. 2 to 8, the present invention provides a card edge connector, which is provided on an upper surface of a circuit board 5 and allows the insertion of an electric card 6, thereby achieving the electrical connection between the circuit board 5 and the electric card 6. The card edge connector comprises an insulating body 1, a plurality of terminals 2, and two metallic pieces 3. The insulating body 1 is made of plastic material and has a body portion 11. The body portion 11 is provided thereon with an insertion slot 12 for allowing the insertion of the electric card 6. An elongated side frame 13 extends from each end of the body portion 11. The inside of each side frame 13 is provided with a platform 14 along the extending direction for disposing the electric card 6 thereon.

Figure 8:
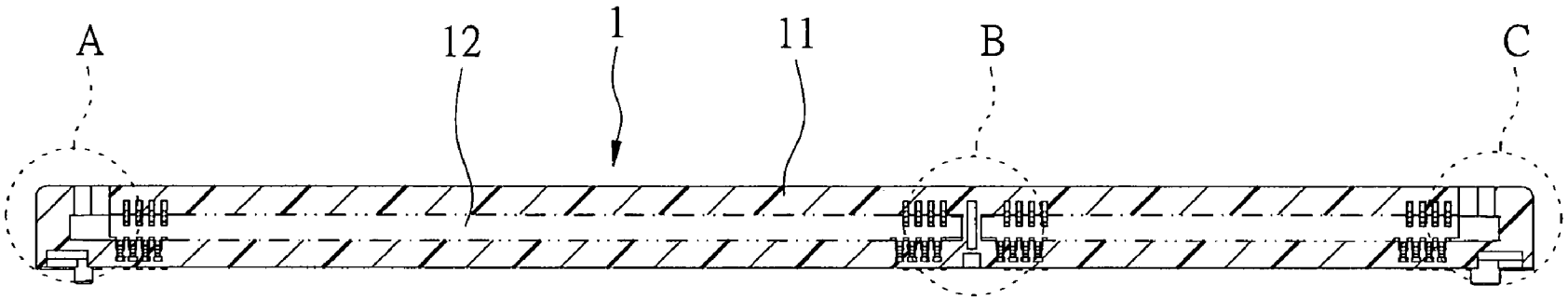
FIG. 8 is a cross-sectional view taken along the line 8-8 in FIG. 7.
Figure 8C:
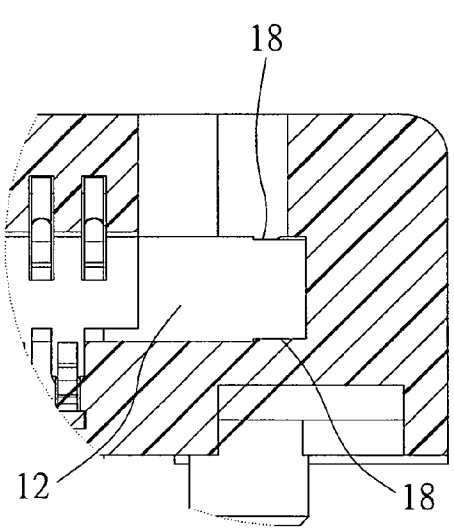
FIG. 8C is a view showing the details of the portion C in FIG. 8.
Figure 8B:
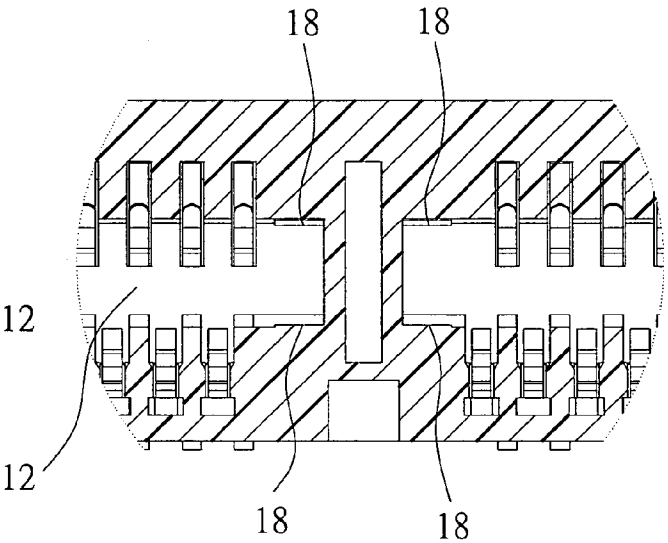
FIG. 8B is a view showing the details of the portion B in FIG. 8.
Figure 8A:
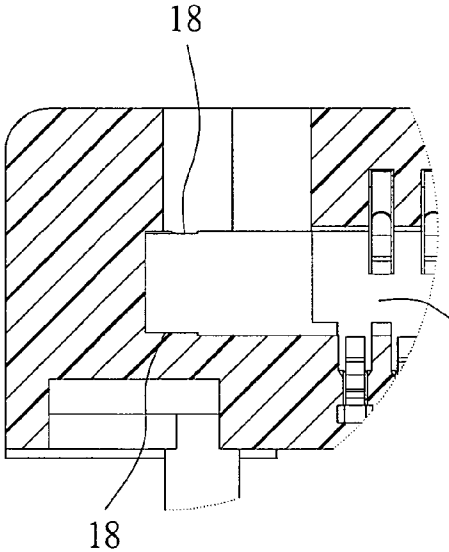
FIG. 8A is a view showing the details of the portion A in FIG. 8.

The middle of the insertion slot 12 of the insulating body 1 is provided with a partition 17 for dividing the insertion slot 12 into two portions. The top surface and the bottom surface within the insertion slot 12 are provided with a plurality of flanges 18 (as shown in FIGS. 8A to 8C). The flanges 18 are integrally formed with the insulating body 1. The flanges 18 are projecting bodies slightly projecting from the top surface and the bottom surface within the insertion slot 12. Preferably, the flanges 18 are provided at corners within the insertion slot 12, that is to say, adjacent to the two side frames 13 and the partition 17. The height between the flange 18 on the top surface and the flange 18 on the bottom surface of the insertion slot 12 exactly allows the insertion of the electric card 6. The flange 18 on the bottom surface and the flange 18 on the top surface are substantially staggered in a front-and-back direction.

Each of the free ends of the two side frames 13 extends to form an elastic hooking arm 15. The inside of the each elastic hooking arm 15 is provided with a positioning block 151 and a projecting block 152. The positioning block 151 is used to lock the corresponding notches 61 of both sides of the electric card 6, so that the electric card 6 cannot move in the front-and-back direction. The inside of the two elastic hooking arms 15 is each provided with a stopping platform 153 adjacent to the positioning block 151. The stopping platform 153 is adjacent to the rear edge of the positioning block 151 and used to stop the lower surface of the electric card 6.

The terminals 2 are provided on the body portion 11 of the insulating body 1. Each of the terminals 2 has a contacting portion 21 and a pin portion 22. The contacting portion 21 is located within the insertion slot 12 for electrically contacting the electrical contacts of the electric card 6. The pin portion 22 extends beyond the body portion 11 for electrically connecting the electrical contacts of the circuit board 5.

The two metallic pieces 3 are made of metallic material by means of pressing. The two metallic pieces 3 are mounted on the two elastic hooking arms 15. Each of the two metallic pieces 3 has a substrate 31, a welded portion 32, a top plate 33, an elastic arm 34, a turning portion 35, a covering portion 36, and a pressing portion 37. The substrate 31 is an upright plate and is provided inside the elastic hooking arm 15. The lower edge of the substrate 31 extends downwardly to form an insertion piece 311 for fixedly inserting into a corresponding insertion hole 16 of the insulating body 1, thereby mounting the two metallic pieces 3 on the insulating body 1 stably.

The welded portion 32 is formed by means of extending horizontally and inwardly from the lower edge of the substrate 31. The welded portion 32 can be welded and fixed on the circuit board 5 to electrically connect the metallic piece 3 with the circuit board 5, thereby grounding the electric card 6. The top plate 33 is formed by means of extending horizontally and outwardly from the upper edge of the substrate 31. The top plate 33 is provided with a constraining hole 331. The constraining hole 331 is located on the top plate 33 and is adjacent to the free end of the elastic hooking arm 15. Further, the top surface of the elastic hooking arm 15 is provided with a constraining block 155 which projects into the constraining hole 331. The width of the constraining hole 331 is greater than that of the constraining block 155 so the constraining block 155 can transversely move in the constraining hole 331. When the constraining block 155 moves outwardly, the constraining block 155 abuts against the outside of the constraining hole 331 and is thus positioned, thereby constraining the position of the constraining block 155.

The elastic arm 34 is formed by means of extending downwardly and forwardly from the outer edge of the top plate 33 at a position near the rear end thereof. The front end of the elastic arm 34 is formed with a free end and is provided on the outside of the elastic hooking arm 15. The elastic arm 34 is provided thereon with a locking hole 341. The locking hole 341 is located on the elastic arm 34 and is adjacent to the free end thereof. The outside of the elastic hooking arm 15 is provided with a locking block 154 that corresponds to the locking hole 341. The locking hole 341 and the locking block 154 are locked to each other.

The turning portion 35, the covering portion 36, and the pressing portion 37 are formed by means of extending inwardly and downwardly from the free end of the elastic arm 34. The turning portion 35 turns the elastic arm 34 and the elastic hooking arm 15 to move outwardly so that the positioning blocks 151 can be detached from the notches 61 of both sides of the electric card 6. Thereby the electric card 6 can be removed easily. The upper edges of the covering portion 36 and the pressing portion 37 are formed into curved surfaces, and guide the electric card 6 to be pressed in to a correct position. The covering portion 36 covers the outside of the projecting block 152 of the elastic hooking arm 15, thereby reinforcing the strength of the metallic piece 3. The bottom surface of the pressing portion 37 is formed with a pressing surface 371 for pressing the upper surface of the electric card 6. The pressing surface 371 is located above the stopping platform 153 with a suitable gap therebetween. Through the design of the above structure, the card edge connector of the present invention is achieved.

In the present invention, the card edge connector can be provided on the circuit board 5 and allows the insertion of the electric card 6 into the insulating body 1, so that the electrical contacts of the electric card 6 can be electrically connected with the circuit board 5 via the terminals 2 within the insertion slot 12. When the electric card 6 is inserted into the insulating body 1, the positioning blocks 151 of the two elastic hooking arms 15 lock the notches 61 of the electric card 6 inwardly, thereby preventing the electric card 6 from detaching from the insertion slot 12. The pressing surfaces 371 of the pressing portions 37 of the two metallic pieces 3 abut against the upper surface of the electric card 6, thereby stabilizing the electric card 6 when the electric card is inserted and obtaining a grounding the electric card. The stopping platforms 153 of the two elastic hooking arms 15 stop the lower surface of the electric card 6. When the electric card 6 is to be removed, the turning portion 35 can turns the elastic arm 34 to move outwardly. The elastic arm 15 also moves outwardly along with the elastic arm, so that the positioning blocks 151 are detached from the notches 61 of both sides of the electric card 6. As a result, the pressing portions 37 of the two metallic pieces 3 are detached from the upper surface of the electric card 6, thereby allowing the electric card 6 to be removed easily.

Since the top plates 33 of the two metallic pieces 3 are each provided with a constraining hole 331, and the top surfaces of the two elastic hooking arms 15 are each provided with a constraining block 155 which is projected into the constraining hole 331, the constraining block 155 abuts against the outer edge of the constraining hole 331 to constrain the position thereof when the elastic arm 34 and the elastic hooking arm 15 are turned outward excessively. Due to this design the elastic arm 34 and the elastic hooking arm 15 are prevented from being turned excessively outward and thus permanent deformation or breakage is avoided.

The advantage of the present invention lies in that the interior of the insertion slot 12 of the card edge connector is provided with a plurality of flanges 18. Therefore, the insertion slot 12 can be made wider to facilitate the insertion of the electric card 6 and prevent the electric card 6 from being inserted into the insertion slot 12 and thereby deforming the insertion slot. When the electric card 6 is inserted into the insertion slot 12, the flanges 18 on the top surface and the bottom surface of the insertion slot 12 abut against the upper surface and lower surface of the electric card 6 respectively, so that the electric card 6 can be stably fixed in the insertion slot 12. As a result, the electric card 6 has greater stability and thereby generates better electrical properties.

While a preferred embodiment of the invention is shown and described, it is envisioned that those skilled in the art may devise various modifications without departing from the spirit and scope of the foregoing description and the appended claims.

What is claimed is:

1. A card edge connector, comprising:

an insulating body having a body portion and a side frame extending from each end of the body portion, the body portion being provided with an insertion slot having a top surface, a bottom surface, a front end and a back end, at least one flange provided on said top surface, at least one flange provided on said bottom surface, the at least one flange on the bottom surface and the at least one flange on the top surface are staggered in a front-to-back direction relative to each other, the flanges are projecting bodies projecting slightly from the top surface and the bottom surface within the insertion slot, a free end of each side frame extends to form an elastic hooking arm; and a plurality of terminals provided in the body portion.

2. The card edge connector according to claim 1, wherein the flanges are provided at corners within the insertion slot.

3. The card edge connector according to claim 1, wherein a middle of the insertion slot is provided with a partition, and the flanges are adjacent to the side frames and the partition.

4. The card edge connector according to claim 1, wherein the terminals have a contacting portion and a pin portion, the contacting portion is located in the insertion slot and the pin portion extends beyond the body portion.

5. The card edge connector according to claim 1, further comprising a metallic piece mounted on each elastic hooking arm.

6. The card edge connector according to claim 5, wherein the inside of each elastic hooking arm is provided with a projecting block, each metallic piece has a covering portion, and the covering portion covers an outside of the projecting block of one of the elastic hooking arms.

7. The card edge connector according to claim 1, wherein the insertion slot allows the insertion of an electric card.

8. The card edge connector according to claim 7, wherein the electric card has notches on both sides thereof, and wherein the inside of each elastic hooking arm is provided with a positioning block, and the positioning blocks lock onto the notches of the electric card.

9. The card edge connector according to claim 7, further comprising a metallic piece mounted on each elastic hooking arm, each metallic piece has a pressing portion, a bottom surface of the pressing portion is formed with a pressing surface, and the pressing surface presses on an upper surface of the electric card.

10. The card edge connector according to claim 7, wherein the bottom surface of the insertion slot defines a first generally planar surface from which the at least one flange on the bottom surface projects and a second generally planar surface which angles downwardly and back from the first generally planar surface of the bottom surface toward the back end of the insertion slot, and wherein the top surface of the insertion slot defines a first generally planar surface from which the at least one flange on the top surface projects and a second generally planar surface which angles upwardly and frontwards from the first generally planar surface of the top surface toward the front end of the insertion slot, the first and second generally planar surfaces of the top and bottom surfaces allow the electric card to be inserted therein at an angle.

11. The card edge connector according to claim 10, wherein the first generally planar surfaces of the bottom and top surfaces are generally parallel to one another, and wherein the second generally planar surface of the bottom and top surfaces are generally parallel to one another.

12. A card edge connector comprising:

an insulating body having a body portion and a side frame extending from each end of the body portion, the body portion being provided with an insertion slot, free ends of the side frames each extending to form an elastic hooking arm;

a plurality of terminals provided in the body portion of the insulating body; and a metallic piece mounted on each elastic hooking arm, each metallic piece has a substrate, a top plate, an elastic arm, and a pressing portion, the substrate is provided at an inside of the elastic hooking arm, the top plate extends outwardly from an upper edge of the substrate, the elastic arm extends from an outer edge of the top plate at a position near a rear end thereof, a front end of the elastic arm is a free end, the elastic arm is provided on an outside of the elastic hooking arm, and the pressing portion extends from the free end of the elastic arm.

13. The card edge connector according to claim 12, wherein each metallic piece has a turning portion, and the turning portion extends from the free end of the elastic arm.

14. The card edge connector according to claim 12, wherein each metallic piece has a welded portion, and the welded portion extends from a lower edge of the substrate.

15. The card edge connector according to claim 12, wherein a lower edge of the substrate extends downwardly to form an insertion piece, and the insertion piece is inserted and fixed into a corresponding insertion hole of the insulating body.

16. The card edge connector according to claim 12, wherein the elastic arm is provided with a locking hole thereon, the locking hole is located on the elastic arm and is adjacent to the free end thereof, the outside of the elastic hooking arm is provided with a locking block corresponding to the locking hole, and the locking hole and the locking block are locked to each other.

17. The card edge connector according to claim 12, wherein a top surface and a bottom surface within the insertion slot are provided with a plurality of flanges.

18. A card edge connector configured to electrically connect an electric card to a circuit board, said card edge connector comprising:

an insulating body having a body portion and a side frame extending from each end of the body portion, the body portion being provided with an insertion slot for receiving the electric card, free ends of each side frame extending to form an elastic hooking arm;

a plurality of terminals provided in the body portion of the insulating body; and a metallic piece associated with each elastic hooking arm, the metallic piece has a substrate and a top plate, the substrate extends generally vertically along an inside of the elastic hooking arm, the top plate extends generally horizontally outwardly from an upper edge of the substrate over a top side of the elastic hooking arm, the metallic piece further includes a welded portion which extends generally inwardly from a lower edge of the substrate.

19. A card edge connector configured to electrically connect an electric card to a circuit board, said card edge connector comprising:

an insulating body having a body portion and a side frame extending from each end of the body portion, the body portion being provided with an insertion slot for receiving the electric card, free ends of each side frame extending to form an elastic hooking arm, the insulating body defines an insertion hole;

a plurality of terminals provided in the body portion of the insulating body; and a metallic piece associated with each elastic hooking arm, the metallic piece has a substrate and a top plate, the substrate extends generally vertically along an inside of the elastic hooking arm, the top plate extends generally horizontally outwardly from an upper edge of the substrate over a top side of the elastic hooking arm, the metallic piece further includes an insertion piece which extends generally downwardly from a lower edge of the substrate, the insertion piece is configured to be inserted and fixed into the insertion hole of the insulating body.

* * * * *